US007886558B2

(12) United States Patent
Wiggs

(10) Patent No.: US 7,886,558 B2
(45) **Date of Patent: *Feb. 15, 2011**

(54) METHOD AND APPARATUS FOR INHIBITING FROZEN MOISTURE ACCUMULATION IN HVAC SYSTEMS

(75) Inventor: B. Ryland Wiggs, Franklin, TN (US)

(73) Assignee: Earth To Air Systems, LLC, Franklin, TN (US)

( * ) Notice: Subject to any disclaimer, the term of this patent is extended or adjusted under 35 U.S.C. 154(b) by 1380 days.

This patent is subject to a terminal disclaimer.

(21) Appl. No.: 11/252,031

(22) Filed: Oct. 17, 2005

(65) Prior Publication Data

US 2006/0096309 A1 May 11, 2006

Related U.S. Application Data

(63) Continuation-in-part of application No. 10/073,515, filed on Feb. 11, 2002, now Pat. No. 6,971,248.

(51) Int. Cl.
*F25D 21/10* (2006.01)

(52) U.S. Cl. ..... 62/282

(58) Field of Classification Search ..... 62/282, 62/272; 165/47, 95, 173, 178, 133
See application file for complete search history.

(56) References Cited

U.S. PATENT DOCUMENTS

| | | | | | |
|---|---|---|---|---|---|
| 2,063,646 | A * | 12/1936 | Whitesel | 62/406 |
| 4,536,765 | A | 8/1985 | Kaminski | 343/704 |
| 4,601,933 | A | 7/1986 | Nakamura | |
| 5,199,486 | A | 4/1993 | Balmer et al. | 165/47 |
| 5,419,135 | A | 5/1995 | Wiggs | |
| 5,623,986 | A | 4/1997 | Wiggs | |
| 5,725,047 | A | 3/1998 | Lopez | |
| 5,799,728 | A | 9/1998 | Blume | |
| 5,946,928 | A | 9/1999 | Wiggs | |
| 6,971,248 | B1 * | 12/2005 | Wiggs | 62/272 |
| 2002/0017516 | A1 * | 2/2002 | McKeen et al. | 219/450.1 |

OTHER PUBLICATIONS

Co-pending U.S. Appl. No. 11/249,586, filed Oct. 13, 2005, by Wiggs.
International Searching Authority, "International Search Report and Written Opinion", Jul. 24, 2008, 7 Sheets.

* cited by examiner

*Primary Examiner*—Melvin Jones
(74) *Attorney, Agent, or Firm*—Miller, Matthias & Hull LLP

(57) ABSTRACT

A non-stick coating, which inhibits frozen moisture accumulation, is applied to exterior exposed portions of heating and cooling systems where ice or other frozen moisture can accumulate and impair system design operational efficiencies; where heat exchange tubing and fins are downwardly sloped or angled; where an optional capillary tube/plate means/design, which plate has an exterior surface that is comprised of at least one of raised dots, ridges, trenches, and a flat surface is utilized; with an optional protective shell encasement which can be shaped to provide a vena contracta effect; with an optional electric fan to enhance airflow for heat exchange; with an optional electric vibrator to enhance inhibition of frozen moisture accumulation; with a downwardly sloped base to direct falling frozen moisture away from the heat exchange equipment; for use in conjunction with an air source heat pump system, an evaporative cooling system or a chiller, or as a supplement to a water-source heat pump system or to a direct expansion heat pump system; and for use with any other refrigerant-based heating system or cooling system.

14 Claims, 3 Drawing Sheets

METHOD AND APPARATUS FOR INHIBITING FROZEN MOISTURE ACCUMULATION IN HVAC SYSTEMS

CROSS-REFERENCES TO RELATED APPLICATIONS

This application is a Continuation-In-Part application which claims benefit of U.S. patent application Ser. No. 10/073,515 filed Feb. 11, 2002,now U.S. Pat. No. 6,071,248 entitled "Method And Apparatus for Inhibiting Ice Accumulations in HVAC Systems" and continuation-in-part application filed Oct. 14, 2005, entitled "Capillary Tube/Plate Refrigerant/Air Heat Exchanger for Use in Conjunction with a Method and Apparatus for Inhibiting Ice Accumulation in HVAC Systems" which is incorporated herein by reference.

A portion of the disclosure of this patent document contains material that is subject to copyright protection. The copyright owner has no objection to the facsimile reproduction by anyone of the patent document or the patent disclosure, as it appears in the Patent and Trademark office patent file or records, but otherwise reserves all copyright rights whatsoever.

STATEMENT REGARDING

FEDERALLY SPONSORED RESEARCH OR DEVELOPMENT

Not Applicable

REFERENCE TO SEQUENCE LISTING OR COMPUTER PROGRAM LISTING

APPENDIX

Not Applicable

BACKGROUND OF THE INVENTION

This invention relates to the field of refrigerant-based heating and cooling systems, and to evaporative cooling systems, and more particularly to a system designed to inhibit condensation or other frozen moisture accumulation on heat exchange equipment or tubing, which tubing is typically finned, and which equipment or tubing is exposed to the air, by means of the application of a non-stick coating to the exterior portion of such air-exposed equipment or tubing, finned tubing, optional plates with refrigerant transport capillary tubes, or the like.

Virtually all heating and cooling systems utilize equipment or a heat exchange means which periodically is exposed to air containing moisture, or water vapor. For example, well-known air source heat pump systems typically utilize exterior heat exchange units consisting of finned copper tubing, which tubing transports a refrigerant such as R22,R-410A, or the like, with an electric fan utilized to blow air over the finned tubing to accelerate heat transfer from the warm air to the cold refrigerant fluid in the heating mode, and from the hot refrigerant fluid to the cool air in the cooling mode. Such a system also typically incorporates an interior air heat exchange unit comprised of finned copper tubing and an electric fan, a compressor which is used to both compress the refrigerant vapor and to circulate the refrigerant fluid through the system, an expansion valve, and other miscellaneous parts and optional apparatus, well known to those skilled in the art/field, depending on the particular design.

While copper is generally utilized for heat transfer tubing in most common refrigerant-based systems applications, other materials, such as aluminum, stainless steel, titanium or the like, may also be utilized for heat transfer tubing, just as various other system components may vary. Also, in large commercial chillers, plastic tubing is commonly utilized to transport water for evaporative cooling purposes, which water has typically been heated from waste heat augmented by heat of compression from a refrigerant-based heat transfer system.

However, when typical air-source heat pump systems are operating in the heating mode, since the refrigerant fluid, which is being circulated into the exterior outdoor heat exchange unit exposed to the air, is typically below the freezing point of water, as the exterior air temperature nears and approaches (typically about 5 degrees C. and below) the freezing point of water (0 degrees C.), humidity in the air collects on the finned tubing and is frozen. This freezing humidity gradually builds up ice accumulations to the extent that it blocks the airflow designed to pass over the finned tubing, thereby rendering the system unable to acquire sufficient heat from the air to operate at design levels. Consequently, a defrost cycle is commonly utilized to remove the ice when the accumulation becomes excessive. The defrost cycle for a residential air source heat pump system typically lasts for about eight minutes, and actually consists of operating the heat pump system in the cooling mode, so as to run hot refrigerant fluid through the exterior finned tubing to melt the ice. As the heat pump system is operating in the cooling mode during the defrost cycle, heat is being taken from the interior air via the interior heat exchange unit, which heat is typically replaced via electric resistance heat or via a fossil fuel means. This periodic defrost cycle results in excessive wear and tear on the compressor, tending to shorten compressor life, as well as in lowered system efficiencies and higher operational costs.

There have been many attempts to make the defrost cycle more efficient, such as using more efficient equipment designs, using stored energy to heat the refrigerant fluid used in the defrost cycle, and the like. However, there remains a need to provide a means to eliminate the necessity for a defrost cycle in an air source heat pump system altogether, and to eliminate unwanted ice accumulations, whether from condensation ice, freezing rain, snow, or hail, on the exterior portion of any refrigerant-based heat transfer system part, whether commercial or residential, resulting from an accumulation of frozen moisture.

Similarly, in large commercial evaporative cooling chillers, which must periodically operate in temperatures approaching or below the freezing point of water, and which sometimes must operate with a cooling load significantly less than called for by system design, the water utilized for evaporative cooling on the exterior of the heat transfer tubing may freeze. Consequently, under such conditions, there is a similar need to provide an efficient means to eliminate the necessity for a costly de-icing operation.

In Wiggs' U.S. patent application Ser. No. 10/073,515, entitled "Method and Apparatus For Inhibiting Ice Accumulation in HVAC Systems," a new and useful method and apparatus was taught to prevent ice buildup on HVAC refrigerant/air heat exchange surfaces via coating the surfaces with a non-stick coating to which ice/frozen moisture would not adhere. While certain examples of suitable refrigerant/air heat exchange means were shown, the present invention discloses other, and potentially better, examples of refrigerant/air heat exchanger means/design which could be alternatively utilized.

SUMMARY OF THE INVENTION

It is an object of the invention to provide a means to inhibit ice accumulations on system component areas of any refrigerant-based heat transfer system or evaporative cooling system where accumulated frozen moisture, such as frozen humidity, frozen rain, snow, or hail, would decrease system operational design efficiencies for any reason. One such decrease in system operational efficiencies, for example, would be occasioned by the necessity for an air-source heat pump system to operate in a defrost mode.

This objective is accomplished by means of applying a non-stick coating to the exterior portion of any refrigerant-based or evaporative cooling based heating or cooling system where undesirable ice accumulation could occur. The non-stick coating will prevent ice from adhering to the exterior finned heat transfer tubing, or to any other air-exposed system surface areas desired. In turn, this will provide advantages such as eliminating the need for a defrost or a de-icing cycle, thereby increasing system operational efficiencies and decreasing system operational costs.

The non-stick coating may be composed of any substance which will inhibit or prevent ice from adhering to the exterior surface of the portion of the refrigerant-based heating or cooling system desired to be protected. When applied to the exterior surface of a heat transfer area, such as the outdoor refrigerant/air heat exchanger, comprised of finned copper tubing and/or a capillary tube/plate, or the like, on an air source heat pump for example, the substance should preferably be of a type that does not, or does not significantly, impede heat transfer in an insulating fashion. However, some minor insulating properties of the non-stick surface coating will typically more than offset the efficiency losses associated with a de-frost cycle. Further, any minor insulating properties can be overcome by simply proportionately increasing the surface area exposure of the heat exchange surface area, as would be well understood by those skilled in the art. Such a non-stick coating may be composed of a substance such as a tetrafluoroethylene resin Teflon®, such as DuPont Teflon® PFA, having a thickness coating of about 0.003 to 0.004 inches, or such as a fluoropolymer dip coating. Another example of such a non-stick coating may consist of plasma-polymerizing a fluoroethylene monomer, such as tetrafluoroethylene, in the presence of the desired exterior surface and depositing a fluoropolymer coating of about 1/10,000 inch or less on the exterior surface. Another example of such a non-stick coating may be a triazine-dithiol derivative, or the like.

While the primary object of the invention is to eliminate the need for a defrost cycle or other ice removal means from refrigerant-based heating and cooling systems and from evaporative cooling systems, certain non-stick coatings may tend to actually enhance thermal conductivity, as taught in U.S. Pat. No. 5,419,135 to Wiggs. Although the primary purpose of this invention is not to teach an exterior coating method to improve thermal conductivity of refrigerant to air heat exchangers, the utilization of such a non-stick coating, which also provides a non-stick surface for ice, would be of some ancillary operational efficiency advantage. Therefore, non-stick coatings of this nature would be preferable to utilize for both the primary purposes of this invention as well as to increase heat transfer efficiencies. While any particular non-stick coating applied may also inhibit the collection of water or other substances, such inhibition alone is likely of lesser value if the non-stick coating does not also inhibit the accumulation of ice, which is the primary purpose of this invention. Other such appropriate non-stick coatings are well known by those in the industry and may continue to be developed.

While the operation of an electric fan alone may blow away any thin film of humidity induced condensation ice, or other form of frozen water, which has not fallen by operation of gravity, from the non-stick exterior air heat exchange coils of a conventional air-source heat pump when operating in the heating mode in the winter, a problem with ice removal could still exist if the fins and/or plates, utilized for air surface contact connected to the refrigerant conductive tubing and/or refrigerant conductive means, are too closely spaced or are horizontally oriented.

To achieve a more reliable ice removal method, in conjunction with the non-stick surface coating, a fin design should be utilized whereby the fins are sloped, or are spiraled, downwardly, or are in a vertical position such that the fins extend in a substantially parallel direction to the longitudinal axis of the tubes transporting the refrigerant fluid, so that gravity alone will pull off any ice forming on the non-stick surface.

As an optional alternative to an improved tubing fin design for use in conjunction with a non-stick surface for frozen moisture, the exterior portion of the refrigerant/air heat exchanger may be comprised of a capillary tube/plate means/design. In this design, refrigerant transport capillary tubes are situated within at least one metal, or the like, plate. The construction of the at least one plate would typically be comprised of a metal, such as copper, aluminum, stainless steel, titanium, or the like, but could be comprised of any material that had an acceptably sufficient heat transfer rate. The plate could be in any form, such as square, rectangular, round, or the like, as would be well understood by those skilled in the art. The capillary tubes evenly distribute the heat transport refrigerant within and throughout the at least one plate, which plate has a large air surface exposure area, so as to facilitate refrigerant/air heat transfer. The actual surface area sizing of the plate necessary to achieve the desired heat transfer rate is well understood by those skilled in the art. The capillary tubes could be comprised of separate small refrigerant transport tubes positioned within the at least one plate, which plate would be comprised of a separate material from the copper, or the like, capillary tubes. In the alternative, for example, the capillary tubes could be comprised of small refrigerant transport holes/passageways within the at least plate itself, such as a plate of copper with a honeycomb of small refrigerant transport passageways drilled and/or formed throughout the plate itself.

By applying a non-stick coating to the exterior air heat exchange unit, with an appropriately sized and/or with an oversized (oversized from present customary sizing) array of downwardly or vertically sloped fins and/or plates, which fins and/or plates serve to increase the surface area exposed to the air, the electric fan on a conventional air-source heat pump system can be either reduced in size or eliminated on the exterior air heat exchange unit, thereby creating enhanced operational efficiencies. The sizing of the exterior air heat exchange unit fins, plates, or the like, necessary to at least one of reduce the size of conventional system exterior fans and to eliminate the exterior fans altogether is well understood by those skilled in the art.

In such an enhanced efficiency design, the non-stick coated finned tubing and/or plates in the exterior air heat exchange unit may be surrounded with a protective shell, which would also be coated with a non-stick coating, with flared openings at the top and at the bottom so as to create a natural vena contracta effect. Thus, as the heat is transferred into the exterior air in the cooling mode, since hot air rises, the natural upward flow will pull cooler outside air in from the bottom, thereby creating a natural air flow over the non-stick coated finned tubing. In the heating mode, since air from which heat is extracted becomes cooler and heavier, the cooled air will naturally fall and will pull warmer air in from the top, again creating a natural air flow. Because of this naturally induced air flow, the conventionally used electric fan can be either eliminated or reduced in size, thereby increasing system operational efficiencies.

The exterior non-stick coated air heat exchange unit must be sufficiently elevated so as to allow falling ice to accumulate underneath the unit without building up from below so as to hamper the heat exchange ability of the refrigerant system. Further, the exterior unit should be furnished with a non-stick coated downwardly sloped base, cone-shaped base, or the like, so falling ice will slide harmlessly to the side, at a sufficient distance away from the unit to avoid any airflow obstruction or any other decrease in system operational efficiencies. Additionally, the exterior unit may be equipped with an optional vibrator, which may be programmed to periodically vibrate the finned heat exchange tubing as appropriate, to further enhance the ability of the non-stick surface coating to remove any ice, or other frozen moisture, build-up. The electrical power required to periodically operate a relatively small vibrator is significantly less than the power required by a conventional defrost cycle.

The exterior non-stick coated refrigerant to air heat exchange unit can be used with or without an electric fan, and with or without a protective shell. The unit can be used with an air-to-air heat pump system, can be used as a supplement to an open loop or a closed loop water-source heat pump system, can be used as a supplement to a direct expansion heat pump system such as those described in U.S. Pat. Nos. 5,623,986 and 5,946,928 to Wiggs, can be used in a commercial evaporative cooling system, or can be used in any other similar application, as would be apparent to those skilled in the art/trade.

When utilized in an evaporative cooling based heating or cooling system, such as a large commercial type for example, as is well understood by those skilled in the art, the non-stick coating would be applied to at least one of, and preferably to both of, the refrigerant to water heat exchanger (a refrigerant to water heat exchanger is well understood by those skilled in the art) and to the water to air heat exchange tubing, which typically consists of round plastic tubing, which is also well understood by those skilled in the art.

BRIEF DESCRIPTION OF THE SEVERAL VIEWS OF THE DRAWINGS

There are shown in the drawings embodiments of the invention as presently preferred. It should be understood, however, that the invention is not limited to the exemplary arrangements and instrumentalities shown in the drawings, wherein.

DETAILED DESCRIPTION OF THE INVENTION

A method and apparatus for inhibiting condensation ice accumulation on heat transfer systems, including refrigerant-based heating and cooling systems, and on an evaporative cooling system, according to the invention, utilizes a non-stick coating applied to heat exchange components and other exterior surface areas of the refrigeration system where ice accumulation is not desirable because such ice decreases overall system operational efficiencies. Additionally, according to the invention, certain optional designs for outdoor air heat exchange means, and an optional vibrator, enhance the ability to eliminate condensation ice build-up.

The following detailed description is of the best presently contemplated mode of carrying out the invention. The description is not intended in a limiting sense, and is made solely for the purpose of illustrating the general principles of the invention. The various features and advantages of the present invention may be more readily understood with reference to the following detailed description taken in conjunction with the accompanying drawings.

Figure 1:
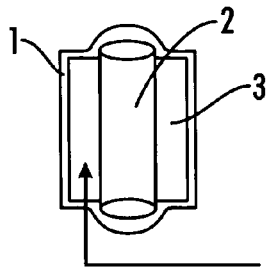
FIG. 1 is a side view of a segment of a vertically finned fluid transport tubing with a non-stick exterior coating applied in accordance with the present invention.

In one embodiment of the invention, as shown via a side view in FIG. 1, not drawn to scale, a heat exchange component of a heat transfer system is shown. The heat exchange component is a segment of fluid (such as refrigerant fluid) transport tubing 2 with two exterior expanded surface area heat transfer fins 3 in thermal contact with, and arranged in a vertical position parallel to the longitudinal axis of, the tubing 2, as conventionally found in refrigerant-based heating and air conditioning systems. An ice, or other frozen moisture, inhibiting non-stick coating 1 is preferably applied to the exterior heat exchange surfaces of the transport tubing 2 and/or the heat transfer fins 3.

Figure 2:
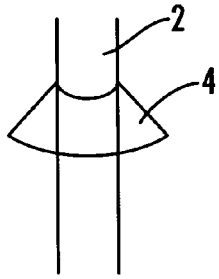
FIG. 2 is a side view of a downwardly sloped heat transfer fin.

Preferably, the heat exchange components are oriented to promote gravity flow of ice away from the component. Thus, FIG. 2 is a side view of a downwardly sloped heat transfer fin 4, which surrounds a fluid transport tubing 2 segment with a vertically oriented longitudinal axis, all coated with a non-stick coating 1 as seen in FIG. 1.

Figure 3:
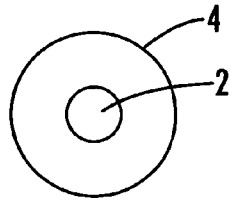
FIG. 3 is a top view of a downwardly sloped heat transfer fin.

FIG. 3 is a top view of a downwardly sloped heat transfer fin 4, which surrounds a fluid transport tubing 2 segment, all coated with a non-stick coating 1 as seen in FIG. 1.

Figure 4:
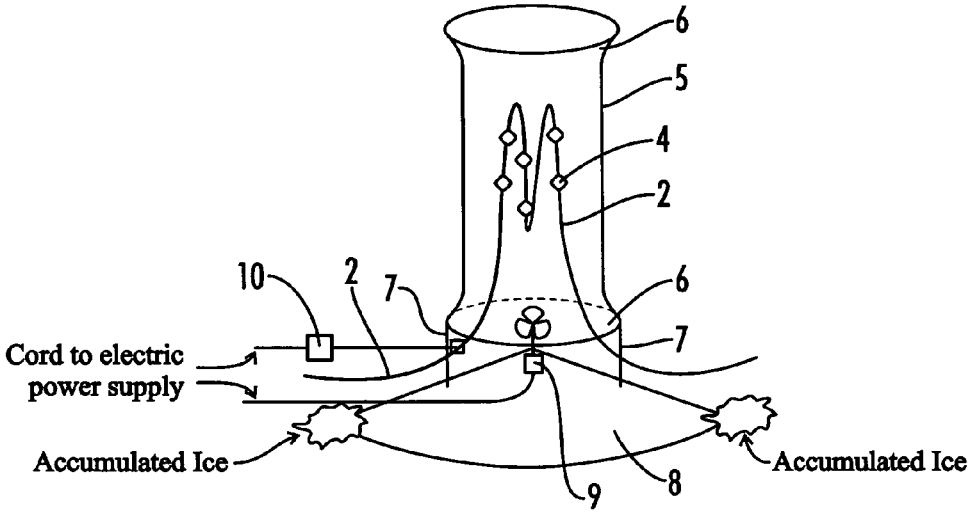
FIG. 4 is a schematic view of primarily vertically oriented, downwardly sloped finned, fluid transport tube, with a protective outer shell shaped to provide a vena contracta air flow effect, with a cone-shaped base to remove falling ice by operation of gravity, with an optional electric fan to enhance airflow, and with an optional electric vibrator to enhance the inhibition of frozen moisture accumulation, all covered with a non-stick coating.

FIG. 4 is a schematic view of a primarily vertically oriented fluid transport tube 2, with attached surrounding and downwardly sloped heat transfer fins 4, shown entering and exiting a protective outer shell 5. Preferably, the shell 5 is shaped to promote convection air flows through the shell. Thus, in the embodiment of FIG. 4, a vena contracta shaped shell 5 has an outwardly flared top 6 and bottom portion 6', with the protective shell 5 supported and elevated by legs 7. A cone-shaped base 8, with a wall that slopes downwardly and outwardly, is centered under the protective outer shell 5, with an optional electric fan 9 to enhance heat transfer and ice removal, and with an optional vibrator 10 attached to at least one of the fluid transport tubes 2, with all exterior components coated with a non-stick coating 1 (not shown). As shown in FIG. 4, the base 8 and shell 5 are shaped to direct falling ice accumulations outwardly so as not to inhibit air flow through the system. Preferably, the exposed surfaces of the fan 9 and vibrator 10 are coated with a no-stick material as well.

Figure 5:
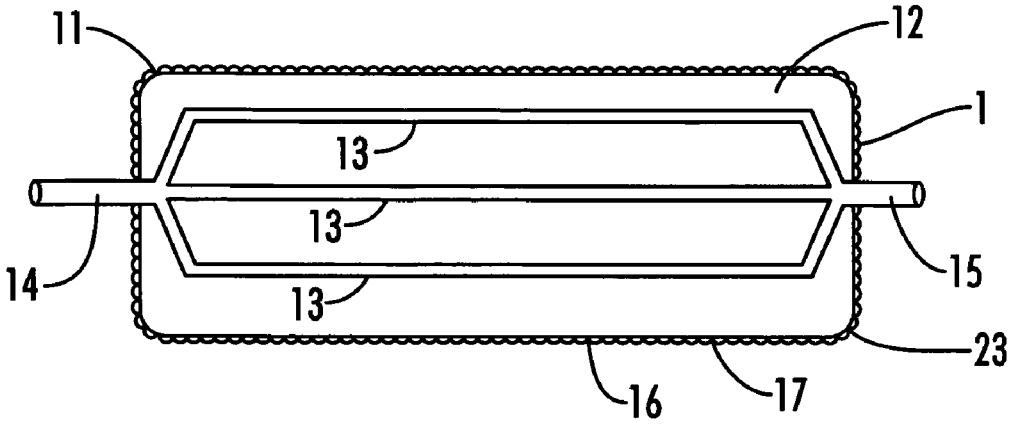
FIG. 5 is a side view of a vertically oriented capillary tube/plate refrigerant/air heat exchanger, which plate contains refrigerant transport capillary tubes situated within the plate and between at least one refrigerant entry/supply line and at least one refrigerant discharge line, and where the exterior of the plate has been coated with a non-stick exterior coating.

FIG. 5 is a cut-away side view of a vertically sloped/oriented 23 capillary tube/plate refrigerant/air heat exchanger 11. The heat transfer plate 12 shown contains refrigerant transport capillary tubes 13 situated within the plate 12 and between at least one refrigerant entry/supply line 14 and at least one refrigerant discharge line 15, and where the exterior 16 surface 17 of the plate 12 has been coated with a non-stick exterior coating 1. (As would be well understood by those skilled in the art, the refrigerant supply line 14 and discharge line 15 would serve in opposite capacities if used in the cooling mode, as opposed to the heating mode, of a reverse-cycle heat pump application.) The refrigerant transport capillary tubes 13 may be comprised of at least one of tubing constructed within the plate 12, and of small holes/passageways drilled/formed within the plate 12 itself, as can be readily understood by those skilled in the art. The passageways do not necessarily have to be tubular 13, as shown herein, but could be comprised of square tubing (not shown), triangular tubing (not shown), a space between one side of the plate 12 and the other (not shown), or the like, as would be readily understood by those skilled in the art. As would also be well understood by those skilled in the art, the one capillary tube/plate refrigerant/air heat exchanger 11 shown herein could be duplicated and utilized in conjunction with others in at least one of a series and a parallel heat exchange application.

The non-stick exterior coating 1 may be composed of any substance which will inhibit or prevent ice, or other frozen moisture, from adhering to the exterior 16 surface 17 of the plate 12. When applied to the exterior 16 surface 17 of the plate 12, the substance should be of a type that does not, or does not significantly, impede heat transfer in an insulating fashion. If some minor insulation factor were to be encountered by means of the particular type of non-stick coating 1 applied, the surface area/size of the plate 12 may be appropriately increased so as to offset the minor heat transfer loss, as would be well understood by those skilled in the art. Such a non-stick coating 1, as applied to any exterior heat exchanger disclosed in this subject invention, may be composed of a substance such as a tetrafluoroethylene resin (PTFE) Teflon®, such as DuPont Teflon® PFA, having a thickness coating of about 0.003 to 0.004 inches, or such as a fluroropolymer dip coating. Another example of such a non-stick coating may consist of plasma-polymerizing a fluoroethylene monomer, such as tetrafluoroethylene, in the presence of the desired exterior surface and depositing a fluoropolymer coating of about 1/10,000 inch or less on the exterior surface. Another example of such a non-stick coating may be a triazine-dithiol derivative, or the like.

In one embodiment of the system, the capillary tube/plate refrigerant/air heat exchanger 11 shown herein would be incorporated into a direct expansion geothermal heat exchange system. Such systems are known in the art and are shown, for example, in U.S. Pat. Nos. 5,623,986 and 5,946,928,both issued to Wiggs, the disclosures of which are incorporated herein in their entirety. For example, the capillary tube/plate refrigerant/air heat exchanger 11 shown herein can be incorporated into the direct expansion geothermal heat exchange system at a point just before the refrigerant enters the subterranean heat exchanger, with such a subterranean heat exchanger being well understood by those skilled in the art and not shown herein.

Figure 6:
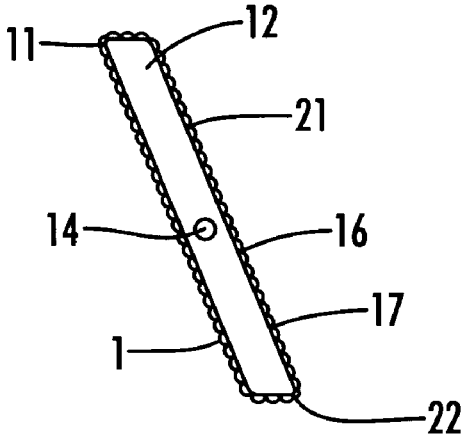
FIG. 6 is a front view of a downwardly sloped capillary tube/plate refrigerant/air heat exchanger, together with a front view of refrigerant entering/supply line.

FIG. 6 is a front view of a downwardly sloped 22 capillary tube/plate refrigerant/air heat exchanger 11, with a flat 21 plate 12 exterior 16 side, together with a front view of refrigerant entering/supply line 14. The exterior 16 surface 17 of the plate 12 has been coated with a non-stick exterior coating 1.

Figure 7:
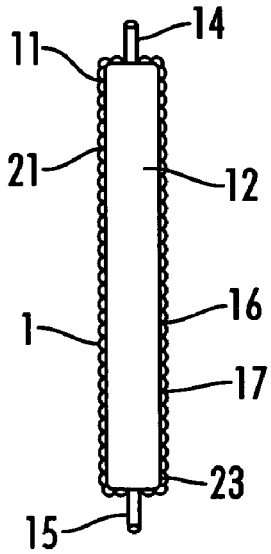
FIG. 7 is a top view of a vertically sloped capillary tube/plate refrigerant/air heat exchanger, with a flat plate exterior side, together with a top view of refrigerant entering/supply line and a refrigerant discharge line.

FIG. 7 is a top view of a vertically sloped 23 capillary tube/plate refrigerant/air heat exchanger 11, with a flat 21 plate 12 exterior 16 side, together with a top view of refrigerant entering/supply line 14 and a refrigerant discharge line 15. The exterior 16 surface 17 of the plate 12 has been coated with a non-stick exterior coating 1.

Figure 8:
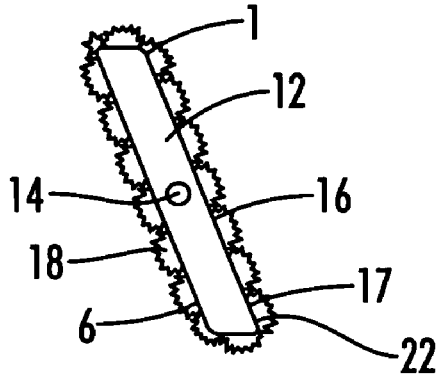
FIG. 8 is a front view of the surface of a plate, with an extended/raised dot exterior side, which surface is dotted with small extended/raised dots so as to increase air exposure surface area, together with a front view of refrigerant entering/supply line.

FIG. 8 is a front view of the surface 17 of a downwardly sloped 22 plate 12, with an extended/raised dot 18 exterior 16 side, which surface 17 is dotted 18 with small extended/raised dots 18 so as to increase air exposure surface 17 area, together with a front view of refrigerant entering/supply line 14. The exterior 16 surface 17 of the plate 12 has been coated with a non-stick exterior coating 1.

Figure 9:
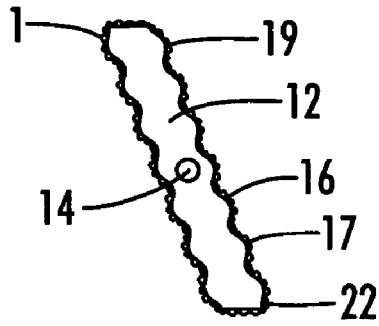
FIG. 9 is front view of the surface of a plate, which exterior side surface is rippled with small ridges so as to increase air exposure surface area, together with a front view of refrigerant entering/supply line.

FIG. 9 is a front view of the surface 17 of a downwardly sloped 22 plate 12, which exterior 16 side surface 17 is rippled with small ridges 19 so as to increase air exposure surface 17 area, together with a front view of refrigerant entering/supply line 14. The exterior 16 surface 17 of the plate 12 has been coated with a non-stick exterior coating 1.

Figure 10:
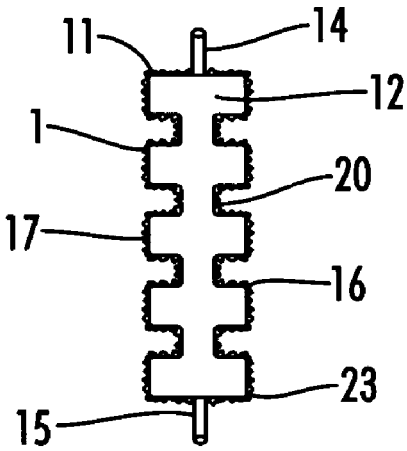
FIG. 10 is a top view of a vertically sloped capillary tube/plate refrigerant/air heat exchanger, with the exterior sides of the plate embedded with trenches so as to increase air exposure surface area, together with a top view of refrigerant entering/supply line and a refrigerant discharge line.

FIG. 10 is a top view of a vertically sloped 23 capillary tube/plate refrigerant/air heat exchanger 11, with the exterior 16 sides of the plate 12 embedded with trenches 20 so as to increase air exposure surface 17 area, together with a top view of refrigerant entering/supply line 14 and a refrigerant discharge line 15. As would be readily understood by those skilled in the art, any plate 12 with a trenched 20 surface 17 would be fitted with trenches 20 that were not horizontally inclined (not shown). A horizontal inclination would obviously prevent frozen moisture (not shown) gravity fall off. The exterior 16 surface 17 of the plate 12 has been coated with a non-stick exterior coating 1.

Figure 11:
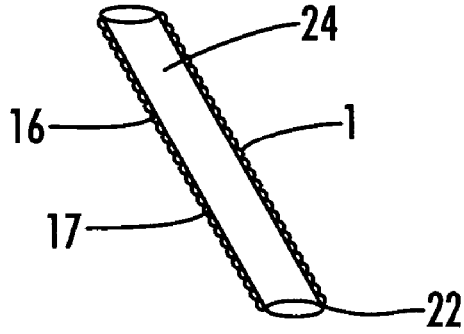
FIG. 11 is a side view of a plastic pipe, which is commonly used in a commercial water/air heat exchanger, which plastic pipe is coated with a frozen moisture inhibiting non-stick coating.

FIG. 11 is a side view of a plastic pipe 24, which is commonly used in a commercial water/air heat exchanger, which water/air heat exchanger is not shown herein as same is well understood by those skilled in the art. The exterior 16 surface 17 of the pipe 24 has been coated with a non-stick exterior coating 1. While ice will tend to slide off a round plastic pipe 24, even if the pipe 24 is horizontally oriented, it would still be preferable to situate the pipe 24 in a downwardly sloped 22 configuration, as shown herein, so as to augment the shedding of frozen moisture by means of gravity.

The non-stick coating 1 referenced in all of the above descriptions may be composed of any substance which will inhibit or prevent ice from adhering to the exterior surface of the portion of the refrigerant-based heating or cooling system desired to be protected. When applied to the exterior surface of a heat transfer area, such as the outdoor finned copper tubing on an air source heat pump (which finned tubing is well understood by those skilled in the art), and/or such as plastic pipe 24 on a water/air evaporative cooling system (a water/air evaporative cooling system is not shown herein as same is well understood by those skilled in the art), the substance should be of a type that does not, or does not significantly, impede heat transfer in an insulating fashion. Such a non-stick coating 1 may be composed of a substance such as a tetrafluoroethylene resin (PTFE) Teflon®, such as DuPont Teflon® PFA, having a thickness coating of about 0.003 to 0.004 inches, or such as a fluroropolymer dip coating. Another example of such a non-stick coating 1 may consist of plasma-polymerizing a fluoroethylene monomer, such as tetrafluoroethylene, in the presence of the desired exterior surface and depositing a fluoropolymer coating of about 1/10,000 inch or less on the exterior surface. Another example of such a non-stick coating 1 may be a triazine-dithiol derivative, or the like.

In one embodiment of the system, a heat exchange component provided with a non-stick coating 1 as described herein is incorporated into a direct expansion geothermal heat exchange system. Such systems are known in the art and are shown, for example, in U.S. Pat. Nos. 5,623,986 and 5,946,928,both issued to Wiggs, the disclosures of which are incorporated herein in their entirety. For example, a heat exchange system as shown in FIG. 4 can be incorporated into the direct expansion geothermal heat exchange system at a point just before the refrigerant enters the subterranean heat exchanger, as would be well understood by those skilled in the art.

Thus, although there have been described particular embodiments of the present invention of a new and useful Method And Apparatus For Inhibiting Frozen Moisture Accumulation In HVAC Systems, it is not intended that such references be construed as limitations upon the scope of this invention except as set forth in the following claims.

What is claimed is:

1. A heat transfer system comprising:

a heat exchange component having a heat exchange surface, fluid transfer tubing, and heat transfer fins in thermal contact with the fluid transfer tubing, wherein the fluid transfer tubing and heat transfer fins are oriented to promote gravity flow of frozen moisture away from the heat exchange component; and a non-stick coating applied to the heat exchange surface, the non-stick coating adapted to inhibit adherence of frozen moisture to the heat exchange surface.

2. A heat transfer system comprising:

a heat exchange component having a heat exchange surface;

a non-stick coating applied to the heat exchange surface, the non-stick coating adapted to inhibit adherence of frozen moisture to the heat exchange surface; and a protective shell positioned around the heat exchange component, the protective shell also having non-stick coating adapted to inhibit adherence of frozen moisture to the shell.

3. The heat transfer system of claim 2 wherein the protective shell is shaped to enhance convection air flows through the shell and around the heat exchange component.

4. The heat transfer system of claim 3 wherein the protective shell further comprises outwardly flared top and bottom portions.

5. The heat transfer system of claim 1 further comprising a fan positioned proximate the heat exchange component.

6. The heat transfer system of claim 5 wherein exposed surfaces of the fan are coated with a non-stick coating.

7. The heat transfer system of claim 1 further comprising a vibrator operatively connected to the heat exchange component to promote release of frozen moisture from the heat exchange surface.

8. The heat transfer system of claim 7 wherein exposed surfaces of the vibrator are coated with a non-stick coating.

9. The heat transfer system of claim 1 further comprising a base positioned below the heat exchange component, the base sloped downwardly and outwardly to direct frozen moisture accumulations away from the heat exchange component, the base provided with a non-stick coating adapted to inhibit adherence of frozen moisture.

10. The heat transfer system of claim 1 further comprising at least one heat exchange component having at least one heat exchange surface plate and a non-stick coating applied to the at least one heat exchange surface plate, the non-stick coating adapted to inhibit adherence of frozen moisture to the at least one heat exchange surface plate.

11. The heat transfer system of claim 10 wherein the at least one heat exchange surface plate component comprises at least one heat conductive plate, which plate contains at least one of refrigerant fluid transport tubing and refrigerant fluid transport passageways.

12. The heat exchange surface plate component of claim 11 wherein the surface of the plate is comprised of at least one of raised dots, ridges, trenches, and a flat surface.

13. The heat exchange system of claim 10 wherein the at least one heat exchange surface plate component is oriented to promote gravity flow of frozen moisture away from the at least one heat exchange component.

14. In a heat exchange system such as an air-source heat pump system, an open loop or closed loop water-source heat pump system, a direct expansion heat pump system, or an evaporative cooling system, the heat exchange system having at least one heat exchange component comprised of at least one heat exchange surface plate, which plate contains at least one of refrigerant transport tubing and refrigerant transport passageways, and a non-stick coating applied to the exterior of the at least one heat exchange surface plate, with such heat exchange surface plate component being oriented to promote gravity flow of frozen moisture away from the at least one heat exchange component.

* * * * *